United States Patent [19]

Grantham

[11] 4,015,930

[45] Apr. 5, 1977

[54] CONTINUOUS LAUNDRY DRYING APPARATUS

[76] Inventor: Frederick W. Grantham, 12055 Goshen Ave., Los Angeles, Calif. 90049

[22] Filed: Sept. 4, 1975

[21] Appl. No.: 610,167

[52] U.S. Cl. ..... 432/105; 34/133; 34/129; 34/131; 34/136; 432/107

[51] Int. Cl.[2] ..... F26B 11/02

[58] Field of Search ..... 432/103, 105, 107; 34/129–134, 242, 56, 109, 136

[56] References Cited

UNITED STATES PATENTS

| | | | |
|---|---|---|---|
| 1,566,778 | 12/1925 | Statham | 34/141 |
| 2,543,579 | 2/1951 | Kauffmann | 34/133 |
| 2,638,687 | 5/1953 | Vincent | 34/136 |
| 2,746,170 | 5/1956 | Wilson et al. | 34/131 |
| 3,509,639 | 5/1970 | Arendt | 34/129 |
| 3,594,918 | 7/1971 | Inester | 34/131 |
| 3,611,584 | 10/1971 | Henson | 34/133 |
| 3,624,919 | 12/1971 | Miller | 34/133 |
| 3,815,257 | 6/1974 | Freze | 34/129 |
| 3,861,865 | 1/1975 | Grantham | 34/133 |
| 3,902,254 | 9/1975 | Files | 34/129 |

*Primary Examiner*—John J. Camby
*Assistant Examiner*—Henry C. Yuen
*Attorney, Agent, or Firm*—Henry M. Bissell

[57] ABSTRACT

A new industrial laundry dryer-conditioner is provided, within a single module, that has continuous flow capabilities for integration with advanced industrial washing apparatus, of the continuous flow type, for continuously and automatically processing laundry items through both the washing and the drying cycles.

5 Claims, 6 Drawing Figures

CONTINUOUS LAUNDRY DRYING APPARATUS

BACKGROUND OF THE INVENTION

1. Field of the Invention

This invention relates to the field of laundry and other article-drying equipment and, more specifically, to dryer-conditioners used in the commercial laundry industry.

2. Description of the Prior Art

An overall view of the prior art in industrial laundry dryer-conditioners, often referred to in the industry as merely "dryers", can be had by referring to my earlier-issued U.S. Pat. Nos. 2,604,313, 2,643,463, 3,443,323, and 3,861,865. The dryers described in those patents and industrial dryers in general require large volumes of air having a temperature in the tumbler in the range of 300°–350° F, in addition to providing the tumbling action to the laundry to achieve rapid but safe drying. In the present state of the art, the "washing" is generally independent of the "drying", or "conditioning", and each operation utilizes separate and detached apparatus, wherein the wet articles are transported from the washing apparatus to the dryer, in some convenient form such as "cakes" or "batches" of wet articles, and loaded therein to start the drying cycle. While the loading is under way, the dryer remains inoperative. Once loaded, however, the dryer would be operated until the load was dry or properly conditioned, after which the dryer would again remain inoperative while the finished laundry was removed and another load added, thus repeating the cycle.

However, the advent of continuous-flow, high-production industrial washing apparatus, in which laundry is added and extracted continuously, has created the necessity for more advanced industrial dryers that will automatically accommodate the continuous output flow of wet articles as they are being emitted from such washing apparatus.

SUMMARY OF THE INVENTION

In general, arrangements in accordance with the present invention avoid the need for industrial-type dryers to be inoperative while they are being loaded or unloaded. I have, in essence, invented an industrial dryer that may be put into continuous operation, without any down time, while wet laundry or other articles to be conditioned, are being added continuously to the dryer while at the same time dried laundry, or finished articles, are continuously being extracted.

One object of this invention is to provide an integrated, self-contained industrial dryer that will automatically receive wet articles, either individually or in cake loads, from continuous-flow type industrial washers.

Correspondingly, another object of this invention is to automatically eject the finished laundry when properly conditioned.

Another object of this invention is to accomplish a total conditioning cycle with a self-contained, single-module dryer that has an adjustable conditioning-time cycle to accommodate the various compositions, and moisture contents, of the articles being conditioned.

A further object of this invention is to provide an integrated dryer and hot air source that eliminates both the refractory end closure and the asbestos covering of conventional combustion chambers.

Still another object of this invention is to provide a dryer housing with a single hot air inlet source, and a corresponding single outlet air return, in which the hot air flow first contacts the wet articles while at its highest temperature, immediately after they are admitted, and then progressively drops in a temperature as the air flow continues around and through the articles towards the outlet air return.

Similarly, an associated object of this invention is to provide an in-rush of cool air onto the conditioned articles at the time they are being ejected from the dryer.

It is an important objective of this invention to provide a dryer-conditioner that will maintain an internal pressure less than ambient during normal operation.

BRIEF DESCRIPTION OF THE DRAWINGS

Other aspects of the invention, along with other objects and advantages thereof, will become apparent from a reading of the detailed description which appears hereinafter, in connection with the accompanying drawings, in which.

DETAILED DESCRIPTION OF THE PREFERRED EMBODIMENT

Figure 1:
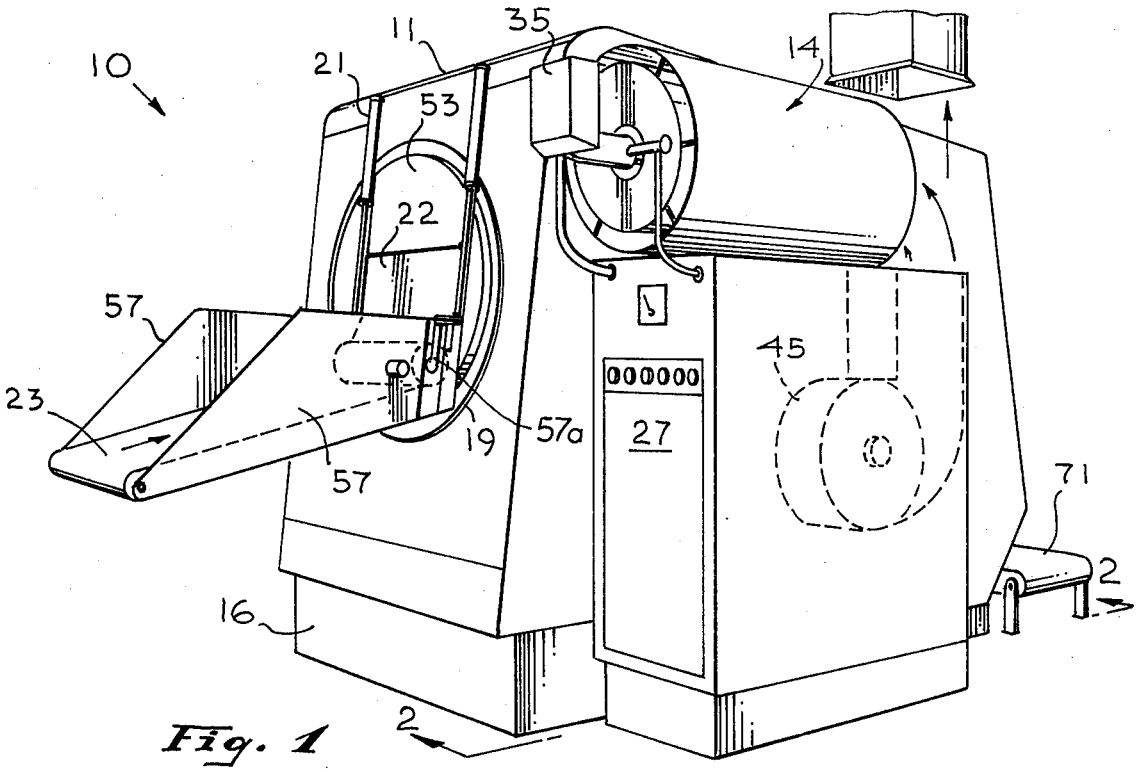
FIG. 1 is a perspective view, in elevation, of a dryer-conditioner system incorporating my invention.

FIG. 1 illustrates the general configuration of the dryer-conditioner system 10. Air is heated in combustion chamber 14 and circulated through housing 11 by blower 45. Control center 27 provides the controls for operating combustion chamber 14 and positioning housing 11 on base 16 which supports housing 11 in a tiltable fashion. Advancing belt 23 transports the wet laundry articles to frontal opening 18, in housing 11, and also to batch door opening 54, in batch door 53 when in place over opening 18. It may be observed that during the normal operation of dryer-conditioner system 10, batch door 53 remains secured in place and in cooperation with seal 19 to form an air seal. The function of this seal will be discussed subsequently. An important aspect of this invention is that the pressure inside the system remains below ambient pressure during normal operation. This is accomplished by additional seals 65 and 63 in cooperation with seal 19. Accordingly, it is important that entry roller 24 form a sealable contact on advancing belt 23 when in contact thereon.

Returning to FIG. 2, drum 12 is rotatably mounted in housing 11 and has openings at both ends through which the articles being conditioned may pass. The walls of drum 12 have perforations 15 throughout to promote the conditioning process through the circulation of heated air around and through the articles that are being conditioned inside the drum. Partitions 13 in drum 12 extend interiorly around the internal periphery of drum 12, leaving an opening 55. In the preferred embodiment, I have included two of these partitions, thus dividing the drum into three equal sections. However, a lesser or greater number of these partitions may be used, thus dividing the drum into fewer or more sections, without affecting the mechanism of this invention for conditioning articles. As may also be observed, there is no requirement that the partitions be equally spaced, as this will not affect the basic mechanisms by which the drum, as hereinafter described, controls the flow of articles therein.

Hot air inlet aperture 29 admits hot air into the system near the end in which the wet articles are loaded. It will be noted that the hot air circulates, as mentioned above, through perforations 15 in drum 12 and exits through hot air outlet aperture 30. A process for the conditioning and circulation of this hot air will be described more fully later; however, at this point it is important to note that the air in its hottest state is imposed upon wet laundry as it enters the system. At this point in the conditioning cycle, the laundry contains its highest moisture content, and will safely endure the higher temperatures without the damage of scorching or burning. In essence, first the hot air expends its energy in vaporizing the high moisture content from the wet articles and causes a relatively small rise in temperature of the articles. Then, as the moisture content is further removed from the articles, the temperature of the conditioned articles will more closely approach the air temperature being impressed on the aritcles at that time. Accordingly, it is important that, as the articles have their moisture content reduced by the circulating hot air, the temperature of the hot air correspondingly decreases to temperatures below that which will cause scorching of the articles. In effect, the hot incoming air is continually decreasing in temperature, by expending thermal energy to reduce the moisture content of the articles, as it progresses through and around the articles within drum 12 and out hot air outlet aperature 30.

Figure 2:
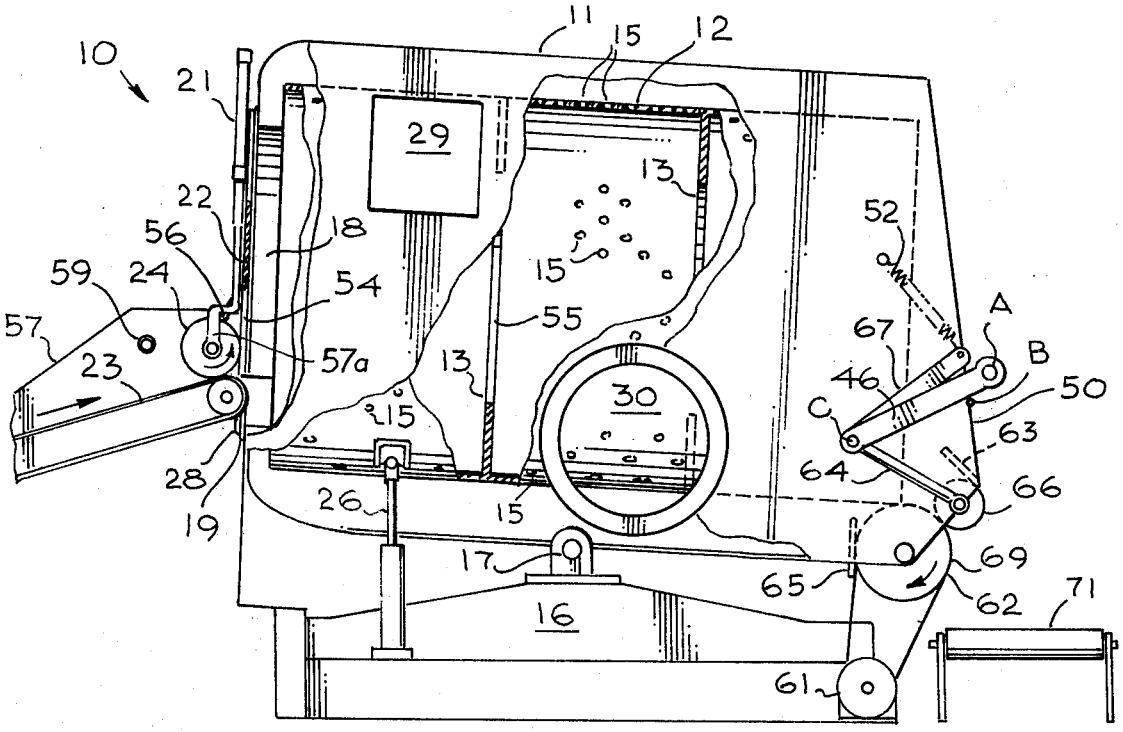
FIG. 2 is a side view, in elevation and partially broken away, of the dryer-conditioner part of the system of FIG. 1.

As shown in FIG. 2, housing 11 is pivotable about journal 17 on base 16. The means for accomplishing this pivoting action is by housing actuator 26, which may be either hydraulic or pneumatic, and is controllable by control center 27. I have found that the rate in which articles pass through this system is dependent in part upon the particular backward tilt of conditioner dryer system 10 during operation. This phenomenon is explainable by assuming a backward tilt, in which the frontal end of housing 11 is raised above the rear section. In this configuration, the wet articles tend to ride the rotating drum upwardly from its lowest rotational side and then fall back towards this side. However, since the drum is tilted backwardly, each time an article rides the wall upwardly and then falls back, it would also progress axially toward the exit end of the drum. It is evident that the greater this tilt, the more rapid this axial progression would become. However, were it not for partitions 13, this progression could become totally random with the lighter synthetic articles progressing much faster than the heavier cotton articles, for example. The function of partitions 13 controls this rate of progression by essentially metering the amount of the load that will be passed through opening 55 with each revolution of the drum 12. This principle is observed by noting that the top side of partition 13 will have a gravity vector displaced rearwardly of the corresponding bottom portion of partition 13 when the drum 12 is in a backward tilt. Accordingly, as the articles closest to the partition rise and fall in the drum, they will tend to fall through opening 55 on their descent. The percentage of the load that passes through opening 55, in partition 13, is controllable by the amount of backward tilt of housing 11. This feature is important so that dryer-conditioner 10 can be adjusted to properly condition articles of various compositions and with various ranges of moisture contents.

Also indicated in FIG. 2, the finished articles exit between exit roller 69 and idler roller 66. Exit roller drive 61 provides continuous rotation to exit roller 69, which in turn rotates idler roller 66. Both rollers 69 and 66 are made of resilient material that is safe to the articles being conditioned. It is my experience that neoprene rubber is a suitable material for the rollers 69 and 66; however, other materials having similar characteristics could serve just as well. Main roller covering 62 is a thin nylon sheath that is wrapped around exit roller 69 to provide a smooth contamination-free surface that will neither stain nor abrade the articles. Conveyor 71 is provided to remove the dried articles which are ejected from the dryer exit rollers 66, 69.

Figure 6:
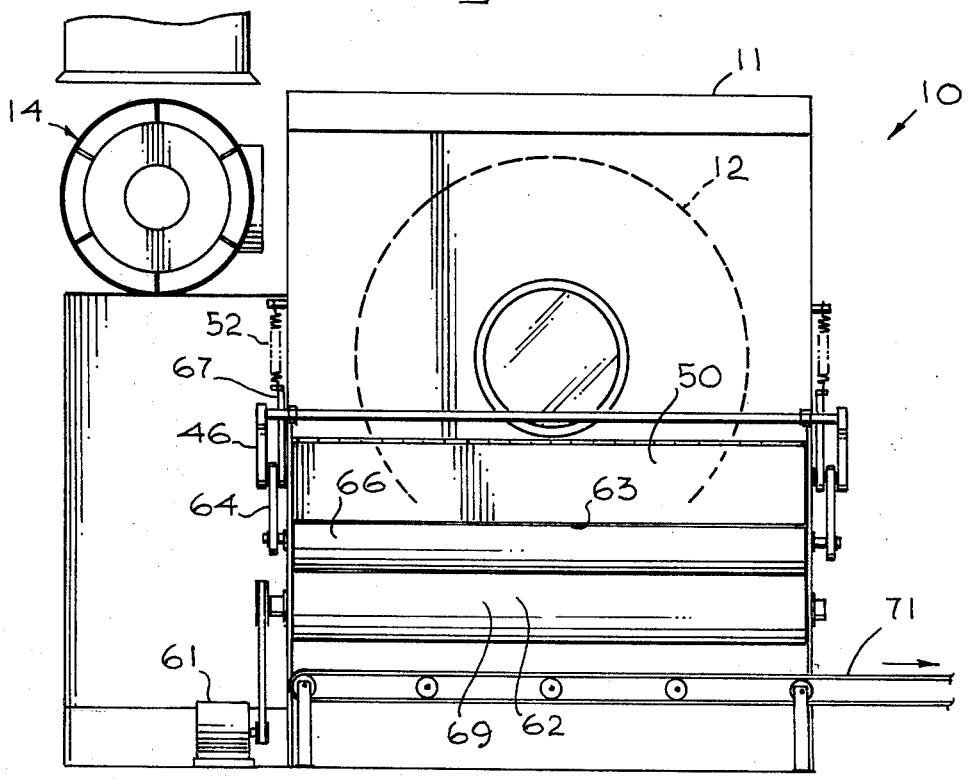
FIG. 6 is a rear view, in elevation, of the dryer-conditioner system.

As stated earlier, it is important that the internal pressure be less than ambient pressure during normal operation of dryer-conditioner system 10. Seals 65 and 63 are installed to provide continuous sealing contact along the full length of their respective rollers. FIG. 6 shows how these rollers 66 and 69 span the full internal width of housing 11.

Returning again to FIG. 2, the mechanism for automatically ejecting the finished articles may be described as follows: as the finished articles progress through the rear opening of drum 12, they are urged by the rotation of roller 69 and roller 66 to move outwardly between the two rollers. Roller 66 is rotatably mounted to right-angle arm 64 which is pivotably connected to lever 67 at point C and connected to housing 11 by tension spring 52. A function of tension spring 52 is to counterbalance the contact force of roller 66 against roller 69 such that the force of an article passing between the two rollers will force roller 66 to pivot away from roller 69 at point C. Exit door 50 rotates outwardly from B when roller 66 is forced away from roller 69. As roller 66 moves away from roller 69, point C will rotate downwardly around point A. In this manner, roller 66 will be moving away from roller 69 by simultaneously pivoting both about point C and point A. When the article has passed through, the rollers will reestablish contact.

As the rollers open to eject an article, atmospheric air is drawn into the housing, through the rollers, to cool the exiting load. As discussed earlier, this occurs due to the pressure inside the housing being less than ambient pressure. In this manner, the articles being ejected are additionally cooled to render them more amenable to immediate human handling.

Figure 4:
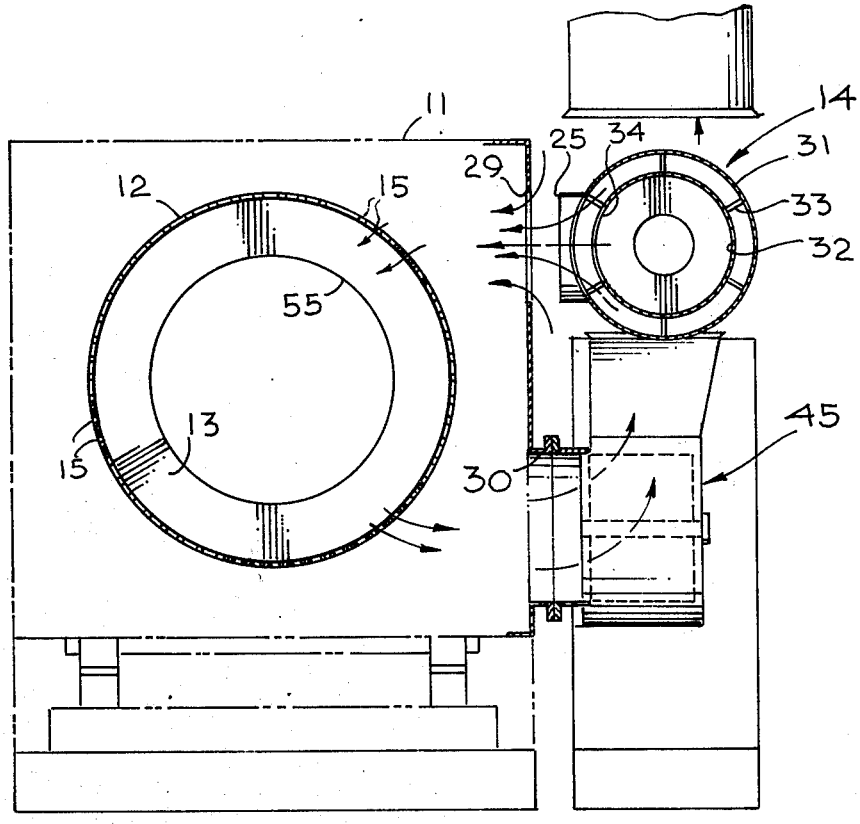
FIG. 4 is a sectional view of the combustion chamber of FIG. 3 taken along the line 4—4 of FIG. 3.

As can be seen from FIG. 4, housing 11 has hot air inlet aperture 29 which is positioned in alignment with aperture 25 in combustion chamber 14. It should be noted, however, that apertures 25 and 29 are not joined by positive seal during operation of the system. A space is provided between apertures 25 and 29 so that the air which is emerging from aperture 25 (and may have temperatures approaching 1700° F) is mixed with relatively cool air from the environment surrounding the system. As a result, the air entering the drum 12 has a temperature approximating 500° F. The need for tempering the air exiting from the combustion chamber is recognized and discussed in my three U.S. Pat. Nos. 2,604,313, 2,643,463, and 3,861,865.

Figure 3:
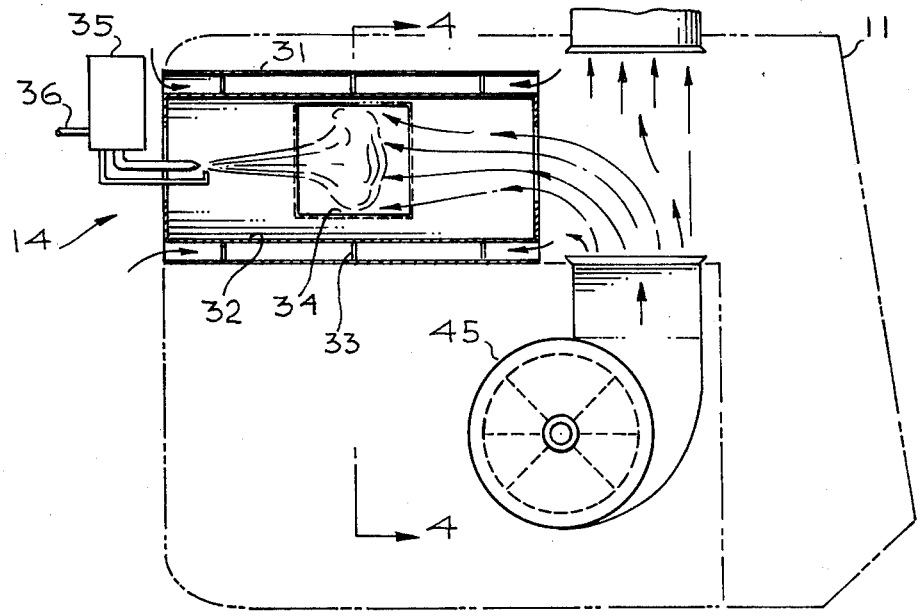
FIG. 3 is a side view, in elevation, of the blower and combustion chamber of FIG. 1 with one combustion chamber wall partially cut away and the air-fuel mixing and introduction means simplified.

Aperture 30 in housing 11 is provided for channeling air out of housing 11 and is positioned so that aperture 30 is aligned with the blower 45, which is described more fully in connection with FIG. 3.

In FIG. 3, combustion chamber 14 has an outer wall 31 and an inner wall 32 separated therefrom by spacer 33 shown more clearly in FIG. 4. Air may enter freely from either end of combustion chamber 14 and pass through the space between outer wall 31 and inner wall 32 of combustion chamber 14. Inner wall 32 has aperture 34 therein which communicates with hot air exit aperture 25 in outer wall 31 and with the space between inner wall 32 and outer wall 31. The fuel introduction and burning system shown in FIG. 3 comprises a fuel-gas mixing chamber 35 which receives fuel through pipe 36 and air, usually under pressure as developed by blower 45 in FIG. 1. Stack 40 removes the moisture-laden exhaust air from blower 45 which is not recirculated in the system. Additional details on this hot air-blower system may be obtained in my U.S. Pat. No. 3,861,865 and the disclosure of that patent is hereby incorporated by reference.

Figure 5:
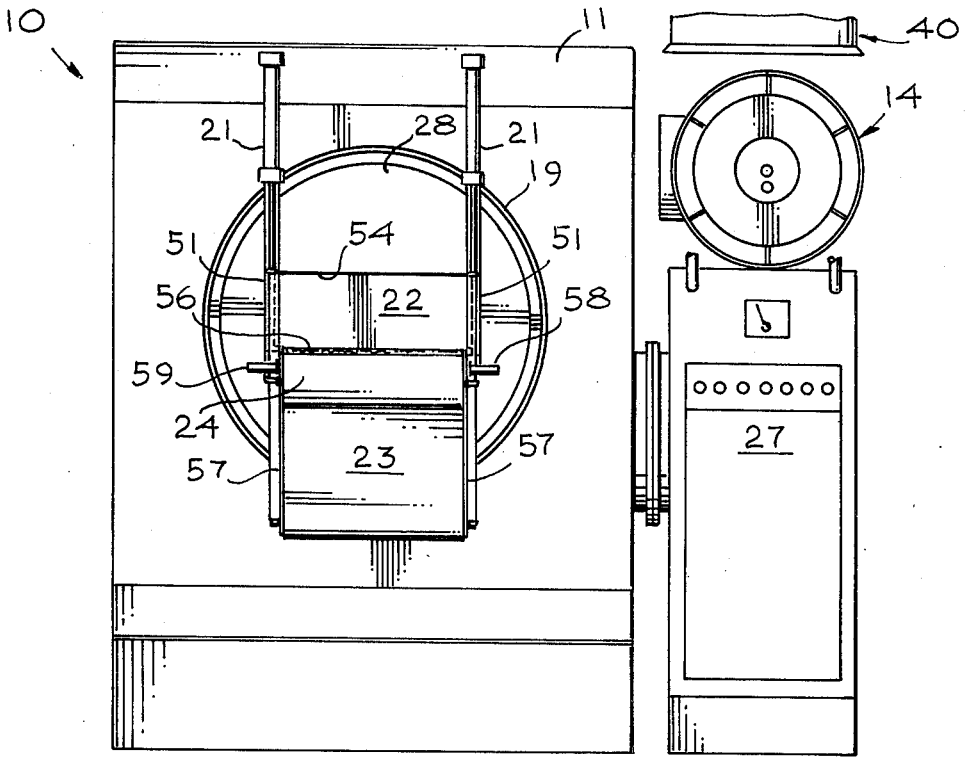
FIG. 5 is a frontal view, in elevation, of the dryer-conditioner system.

Referring now to FIG. 5, the ingress of articles to be conditioned is described more fully. As can be observed, advancing belt 23 advances to the base of opening 54 in batch cover 28. Roller 24 normally rests on advancing belt 23 with the movement of advancing belt 23 causing roller 24 to rotate. It is important that roller 24 form a sealable contact on advancing belt 23 when in contact thereon, as previously discussed. The bottom of sliding door 22 is affixed to the two roller end support members 57*a* that provide the rotatable support for roller 24. Extending the length of roller 24 and affixed to the lowest edge of sliding door 22 is seal 56 which provides continuous sealing between roller 24 and door 22. The outer edges of door 22 are slidably mounted in door slides 51. Actuators 21, located on each side of sliding door 22, provide means for raising door 22 when activated as hereinafter described. In my invention these actuators are pneumatic; however, hydraulic actuators may be used if desired. A light source 59 mounted on either side of advancing belt 23 provides a collimated beam directed toward a photoelectric cell 58 mounted on the opposite side of advancing belt 23. Associated with the light source 59 and photoelectric cell 58 are the necessary controls, as known in the art, such that when the light source is broken by an ingress of laundry articles, an energizing source will be directed to actuators 21, causing door 22 and roller 24 to be raised. In this manner, as larger loads are fed into housing 11, having a height sufficient to break the light beam, an opening will automatically occur to receive them. The height of light source 59 and photoelectric cell 58 may be adjusted such that any article that does not break the beam from light source 59 will pass freely between advancing belt 23 and roller 24 and into housing 11 from the combined urging of advancing belt 23 and roller 24 forcing door 22 to raise sufficiently to pass the article thereunder, after which the door will automatically close under gravitational force.

It will be appreciated that only the significant details of the present invention are shown in the drawing, others of conventional configuration having been omitted for simplicity. Thus, for example, the input and output conveyors, the outlet rollers, the drum and the blower are all driven by electric motors, coupled and controlled by conventional means. These details need not be shown herein, as they are known in the art.

While a particular dryer-conditioner system has been shown and described herein for the purpose of illustrating the manner in which my invention may be used to advantage, it will be appreciated that my invention is not limited thereto. Accordingly, any and all modifications, variations, or equivalent arrangements which may occur to those skilled in the art should be considered to be within the scope of my invention.

What is claimed is:

1. Apparatus for drying laundry articles comprising:

a housing having an article loading means and a dried article ejection means spaced therefrom, wherein the article loading means comprise:

a. an inlet opening in said housing for receiving batch loads;

b. a closure mechanism movable over said inlet opening and responsive to gravity to move to a closed position;

c. a conveyor external to said housing and positioned to feed articles to said inlet opening;

d. first means adjacent the conveyor and responsive to articles thereon of a first selected size to open mechanically and automatically said closure mechanism by an amount related to the size to the article; and e. second means adjacent the conveyor and responsive to articles thereon of a second selected size larger than said first size to open mechanically and automatically said closure mechanism for a predetermined time interval;

the apparatus further comprising:

a single rotary drum having an article input portion adjacent to said article loading means and an article exit opening at its opposite end and in communication with said dried article ejection means;

an air inlet opening into an article input portion of the drum, and air outlet means for receiving air from the drum and for imparting an axial component to the air flow toward the dried article ejection means in the direction of movement of laundry articles toward the ejection means;

air conduit means mounted externally of said housing having portions in alignment with said air inlet opening and said air outlet means respectively;

an air heating means and an air blower means mounted in said air conduit means; and annular partition means having a central opening and extending radially interiorly from an internal periphery of the rotary drum walls to divide the drum into a plurality of sections.

2. Apparatus of claim 1 wherein the first means comprise a door and a roller connected thereto and driven by the conveyor so as to raise the door by an amount necessary to admit the article of the first selected size between the roller and the conveyor into the drum.

3. Apparatus of claim 2 wherein the second means includes means for automatically lifting the roller and the door by a predetermined amount sufficient to admit the articles of said second selected size upon detection of the presence thereof.

4. Apparatus of claim 3 wherein the means for automatically lifting the closure mechanism comprise:

a. a light source positioned at one side of said conveyor to direct a light beam over said conveyor to a photodetector mounted on the opposite side of said conveyor;

b. said light source and said photodetector being mutually adjustable to very the height above the conveyor of the light beam; and c. an actuator responsive to an interruption of the light beam to raise the roller and the door to an open position.

5. Apparatus of claim 4 wherein the actuator comprises a pneumatic cylinder coupled between the housing and the door.

* * * * *